US006024309A

United States Patent [19]

Karlström

[11] Patent Number: 6,024,309

[45] Date of Patent: Feb. 15, 2000

[54] METHOD FOR GUIDING THE BEATING IN A REFINER AND ARRANGEMENT FOR PERFORMING THE METHOD

[76] Inventor: Anders Karlström, Älegärdsgatan 230, S-431 50 Mölndal, Sweden

[21] Appl. No.: 09/171,335

[22] PCT Filed: Apr. 7, 1997

[86] PCT No.: PCT/SE97/00577

§ 371 Date: Oct. 15, 1998

§ 102(e) Date: Oct. 15, 1998

[87] PCT Pub. No.: WO97/38792

PCT Pub. Date: Oct. 23, 1997

[30] Foreign Application Priority Data

Apr. 15, 1996 [SE] Sweden ..... 9601420

[51] Int. Cl.[7] ..... B02C 25/00

[52] U.S. Cl. ..... 241/28; 241/34; 241/37

[58] Field of Search ..... 241/34, 37, 28, 241/261.2, 261.3, 259.1, 259.2, 259.3

[56] References Cited

U.S. PATENT DOCUMENTS 4,184,204 1/1980 Flohr ..... 241/37

FOREIGN PATENT DOCUMENTS 407 952 4/1979 Sweden .
9403743 11/1994 Sweden .

*Primary Examiner*—Mark Rosenbaum
*Attorney, Agent, or Firm*—Lerner, David, Littenberg, Krumholz & Mentlik, LLP

[57] ABSTRACT

Methods and apparatus are disclosed for controlling the beating of fibrous material to be treated in a refiner. The method includes measuring a property of the fibrous material treated in the refiner, measuring the temperature or pressure in the beating zone between the refiner disks, and altering the temperature in the beating zone based upon the measured property of the fibrous material treated in the refiner. The apparatus disclosed includes pressure and temperature gauges for measuring the pressure and temperature in the beating zone, gauges for measuring the property of the fibrous material treated in the refiner, a computer to compare the measured values of the temperature or pressure with desired values for these parameters, and a controller for altering the temperature in the beating zone based upon the measured value of the property of the fibrous material treated in the refiner.

12 Claims, 2 Drawing Sheets

METHOD FOR GUIDING THE BEATING IN A REFINER AND ARRANGEMENT FOR PERFORMING THE METHOD

FIELD OF THE INVENTION

The present invention relates to a method for controlling the beating in a refiner which beats wood chips in a water suspension to produce a cellulose mass for paper production. The present invention also relates to the fine grinding of a beaten mass in a further refiner.

BACKGROUND OF THE INVENTION

For a long time it has been common practice to heat wood chips in a refiner in order to produce a mass, which can then be processed into paper or paper products. Refiners, which are often called beaters or pulpers, are used for the beating of different types of cellulose masses which may contain or be freed from lignin.

In principal there are two different types of refiners, namely so-called conical refiners and disk refiners. In the former, a cone having knives on its surface rotates, and is surrounded by a corresponding conically-shaped mantle, which is also provided with knives, in this case on its inner surface. A suspension of chips in water is then allowed to flow from the narrow end of the cone to its wider end, while the cone rotates and the chips are beaten in the beating gap which exists between the cones.

Disk refiners are possibly more commonly used, and consist principally of a stationary disk against which a corresponding disk rotates with a certain degree of play. So-called twin refiners may also be used, in which stationary disks are arranged at either side of the rotating disk. Also, so-called double-rotating or counter-rotating disk refiners are used in which both beating disks rotate counter to each other, and the material to be ground is introduced through the center of one of the disks, which is provided with spokes. Those surfaces of the disks which face each other are provided provided with knives. The material to be ground is introduced in the central part between the disks and is conveyed out towards their periphery during the beating process. To obtain efficient beating, the disks must be pressed against each other and one of the beating disks, preferably the stationary one, is therefore provided on one side with a pressure arrangement, preferably of a hydraulic type, so that it can be pressed against the other, or rotating disk. The resulting pressure which, for example, is suitable for beating chips, is up to a few bars, for example 6 bars, and the temperature is, in such a case, between about 170° C. and 180° C. This means that the water is at its boiling point, and saturated steam is preferably created to some extent. It is also possible to carry out the beating at higher temperatures, whereby super-heated steam is created.

The process which occurs in a disk beater is schematically illustrated in FIG. 1. This figure represents a sectional view of a stationary grinding disk 1 against which a rotating grinding disk 2 is pressed, using a suitable pressure. The material to be ground 3 arrives at the center and is conveyed outwardly against the periphery past the arrows shown thereon.

The temperature of the material which is thus beaten rises from the center outwardly towards the periphery. This occurs as a matter of course, due to the inner friction which arises between the beating disks and the chips/mass suspension introduced therebetween. This friction is small at the center where the grinding disks have a small peripheral velocity and a large beating play, but it rises outwardly with a rising peripheral velocity of the grinding disk 2 and decreased grinding play. It has therefore always been believed that the highest temperature is obtained closer to the peripheral part of the beating disks in an area which is denoted by reference numeral 4 in the Figure. However, it has been shown that the maximal temperature is in the area which is marked with reference numeral 5 for refiners which are fed with chips, and centered to 6 for refiners which are fed with pulp; i.e., substantially further towards the center.

FIG. 2 shows two curves which plot the temperature against the radius from the center of the beating disks. The curve 1 has been drafted for a maximum pressure of 6 bars between the beating disks 1 and 2, corresponding to a highest temperature of from about 170° C. to 180° C., the so-called pressure peak, which in this case is near the center. The curve 2 has been drafted for a pulp refinery, and accordingly the pressure peak and the temperature peak have in this case been displaced to the right; i.e., closer to the periphery of the grinding disks. The curve 2 relates primarily to a beating material which has been previously beaten, and the pattern of the beating disks is therefore somewhat finer.

Swedish Patent No. 407,952 discloses a method and apparatus for controlling the beating in a refiner including temperature and pressure gauges supplying signals to a computer which conducts the beating process. The signal values are, however, not used for the purpose of controlling the quality of different parameters of the mass, or of paper produced from the mass.

The above discussion represents an example of the fact that the beating conditions in a refiner can vary greatly. These conditions, in turn, influence the quality of different parameters of the finished beaten pulp, or of the paper which is produced from this pulp. Accordingly, there is a considerable need to be able to influence the beating process so that the desired parameters can be obtained. The physical properties which influence the beating conditions are the pressure in the beating zone, the temperature in the beating zone, and the concentration of chips and fibers. If the quality parameters are to be influenced, these physical conditions must accordingly be controlled; i.e., the feed of chips and water, the temperature of the water, and the pressure; i.e., the hydraulic pressure which is applied against one of the beating disks. No one has previously been able to predict how these factors cooperate and how they can be regulated in order to produce a desired result.

SUMMARY OF THE INVENTION

In accordance with the present invention, these and other objects have now been realized by the discovery of a method for controlling the beating of fibrous material to be treated in a refiner including a pair of juxtaposed refiner disks defining a beating zone therebetween, the method comprising measuring at least one predetermined property of the fibrous material treated in the refiner, measuring at least one of the temperature and pressure in the beating zone, and altering the temperature in the beating zone based upon the measured at least one predetermined property of the fibrous material treated in the refiner. In a preferred embodiment, altering of the temperature in the beating zone is effected by controlling a predetermined parameter within the beating zone. Most preferably, the predetermined parameter in the beating zone can be the applied pressure on the refiner disk, the rate of flow of the fibrous material into the beating zone, the rate of flow of nozzle water into the beating zone, and the steam pressure in the beating zone.

In accordance with one embodiment of the method of the present invention, the at least one predetermined property comprises a property such as dewatering ability, fiber length, fiber width, the proportion of shives, and tear resistance.

In accordance with another embodiment of the method of the present invention, the at least one predetermined property comprises light dissipation or tensile strength.

In accordance with another embodiment of the method of the present invention, the method includes comparing the measured value of temperature or pressure to desired values for the temperature and pressure, and in which variations in the temperature and pressure based on that comparison are utilized for the altering of the temperature in the beating zone. In a preferred embodiment, comparing of the measured value of the temperature or pressure with the desired values for the temperature and pressure are carried out in a computer.

In accordance with another aspect of the present invention, apparatus is provided for controlling the beating of fibrous material to be treated in a refiner including a pair of juxtaposed refiner disks defining a beating zone therebetween, the apparatus comprising pressure and temperature gauges for measuring the pressure and temperature in the beating zone, measuring means for measuring at least one predetermined property of the fibrous material treated in the refiner, a computer for comparing the measured value of the at least one of the temperature and pressure with a desired value for the temperature and pressure, and control means for altering the temperature in the beating zone based upon the measured value of the at least one predetermined property of the fibrous material treated in the refiner. In a preferred embodiment, the control means controls a predetermined parameter within the beating zone. In another preferred embodiment, the predetermined parameter includes the applied pressure on the refiner disk, the rate of flow of the fibrous material into the beating zone, the rate of flow of nozzle water into the beating zone, and the steam pressure in the beating zone.

In accordance with one embodiment of the apparatus us the present invention, the at least one predetermined property comprises dewatering ability, fiber length, fiber width, the proportion of shives, and tear resistance.

In accordance with another embodiment of the apparatus of the present invention, the at least one predetermined property comprises light dissipation or tensile strength.

It has been desired for a long time to be able to control the quality of the beaten pulp and to keep the beating process constant so that a desired pulp is continuously obtained. In accordance with the present invention, a method has now been obtained for controlling the beating in a refiner, whereby, in order to influence the quality of different parameters for the beaten mass, the applied pressure on the beating disks in the refiner, the feed of chips and nozzle water, and possibly the steam pressure, are regulated by means of values obtained from the measured pressures and temperature in the beating zone. The present method is thus one in which, in the event of sinking or rising values of the following quality parameters, namely dewatering ability, fiber length, fiber width, shives, content, and/or tear resistance of the beaten mass or of the paper produced therefrom, the temperature in the beating zone is lowered or raised, and when the following parameters, namely light dissipation and tensile strength, either fall or rise, the temperature in the beating zone is raised or lowered, respectively.

The expression "nozzle water" refers to the water which is added to the chips through a nozzle to prepare a chip suspension.

According to the present invention, the temperature is regulated in the beating zone by means of applied pressure, the feed rate of chips or nozzle water, or a combination of these values.

According to the present invention, the measured values of the pressure and the temperature are fed into a computer unit, into which the desired values of these parameters are fed, whereby deviations from these desired values are fed into a control unit which regulates the applied pressure on the beating disks in the refiner, the feed rate of chips or water into the beating zone, and possibly the vapor pressure.

The present invention also includes apparatus for performing the above method, which apparatus includes a refiner having temperature and pressure gauges in the beating zone, a computer containing the desired values for pressures and temperatures in the beating zone, which computer is adapted to be continuously fed with the measured pressures and temperatures in the beating zone, and to forward differences between the actual and desired values to a steering or control unit for controlling the applied pressure on the beating disks in the refiner and/or the feed rate thereto of chips, pulp and water, and possibly the vapor pressure in a manner such that in the event of lowering or rising values of the following quality parameters, namely dewatering ability, fiber length, fiber width, shives content and tear resistance of the beaten mass, or of the paper produced therefrom, the temperature in the beating zone is lowered or raised, and when the following parameters, namely light dissipation and tensile strength, fall or rise, the temperature in the beating zone is raised or lowered, respectively.

BRIEF DESCRIPTION OF THE DRAWINGS

The present invention may be more fully appreciated with reference to the following detailed description, which, in turn, refers to the Drawings, in which.

DETAILED DESCRIPTION

Figure 1:
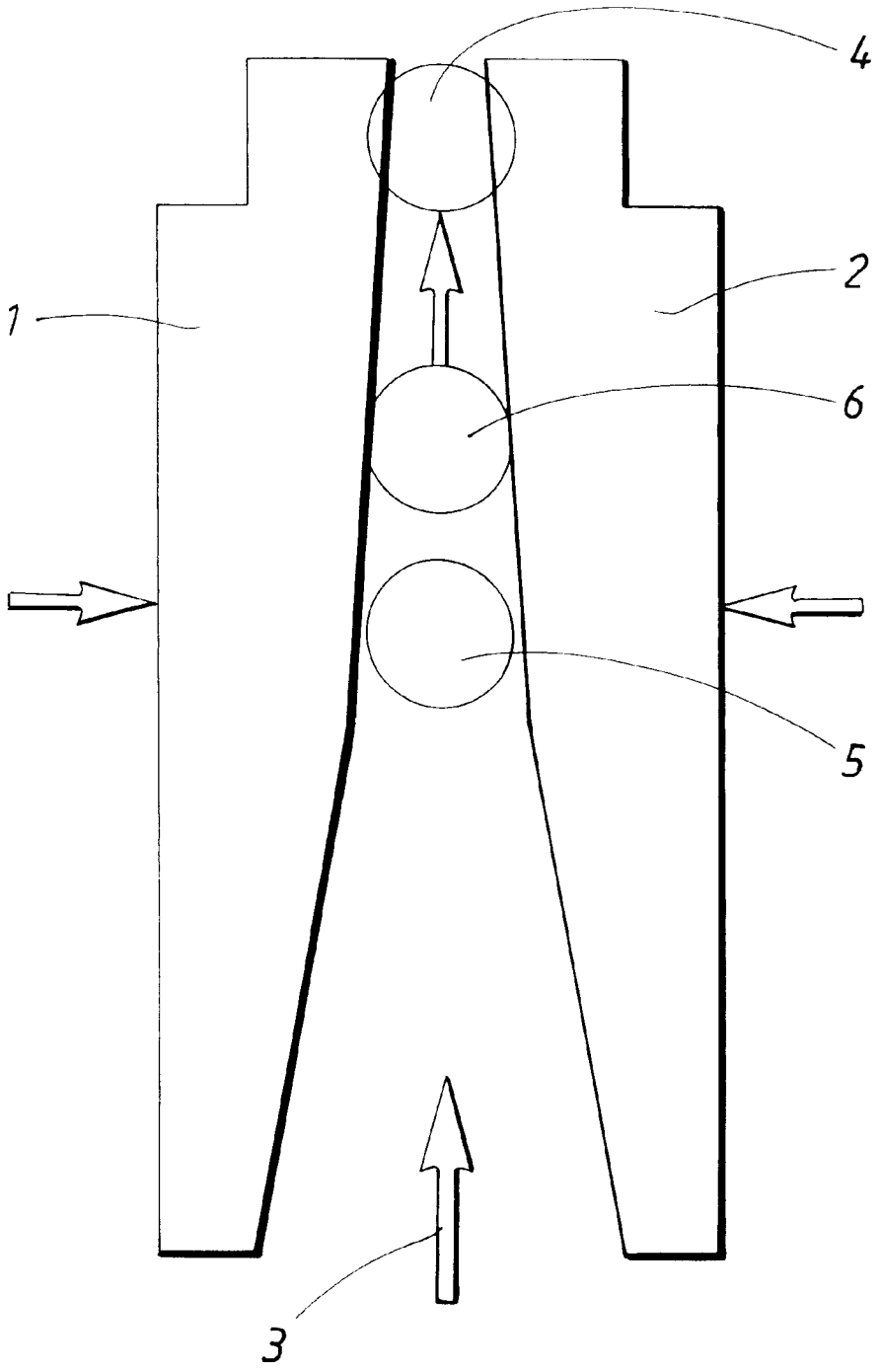
FIG. 1 is a side, schematic, representational view of a beating zone in a disk refiner in accordance with the present invention.
Figure 2:
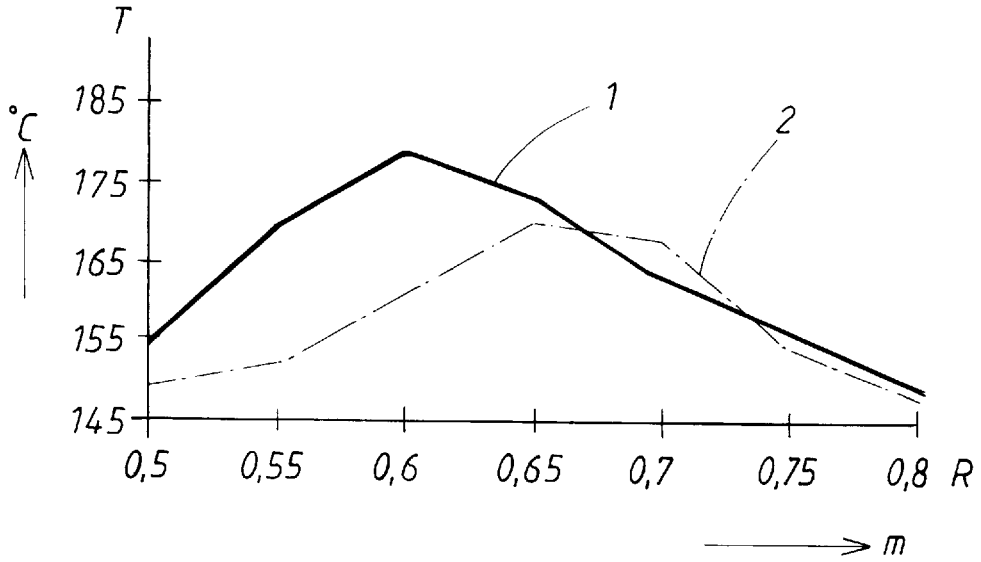
FIG. 2 is a graphical representation of the temperature versus the radius from the center of the beating disks in a disk refiner in accordance with the present invention.
Figure 3:
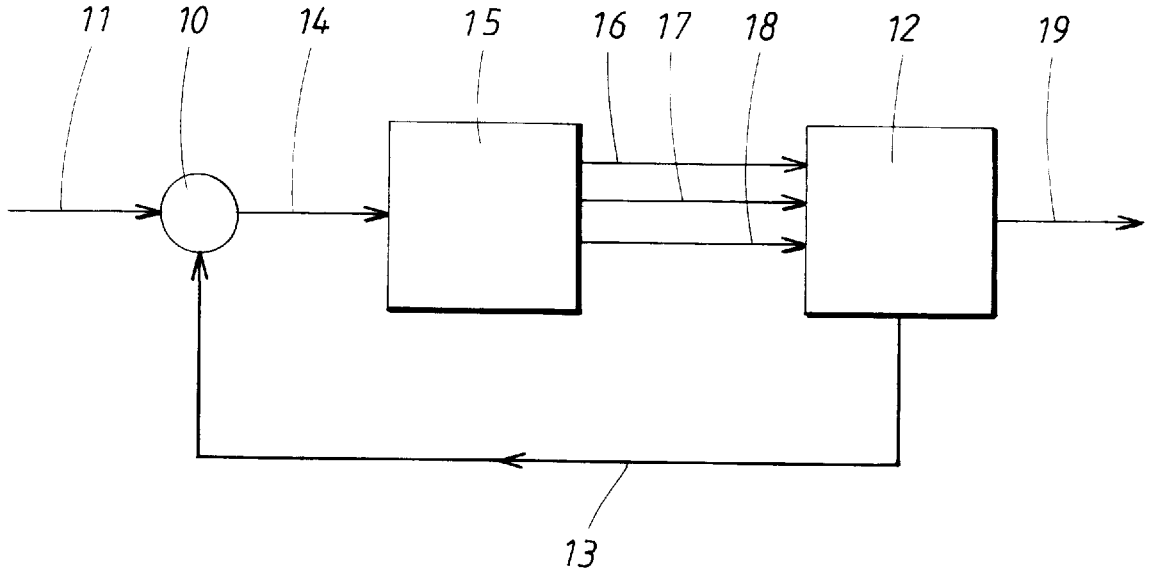
FIG. 3 is a schematic representation of a system for controlling beating in a beating zone in accordance with the present invention.

Referring to the Drawings, FIG. 3 schematically shows controlling the process of beating wood chips. The unit 10, which is a computer or similar electronic equipment, is fed with the desired values 11, which are stored in this unit 10. From the process 12, intermittently and with a high sampling speed, the measured pressures and temperatures are fed into computer 10, and the difference between these values (ACTUAL VALUES and DESIRED VALUEs) 14 is fed into the control unit 15, which controls the hydraulic pressure 16, the chip flow 17 and/or the amount of nozzle water. The temperature in the process 12 can also be influenced by the temperature of the nozzle water, but it is generally kept constant, and is appropriately regulated by heating before the water is fed into the process. The beaten mass is removed from the process at reference numeral 19.

The method according to the present invention is not limited to any specific arrangement for gauging pressures and temperatures in the beating zone. Such arrangements are, however, known, such as, for example, in Swedish Patent Application No. 9403743-9. By means of this arrangement, measurements of pressures and temperature can be made within intervals of milliseconds, if so desired. It is therefore possible to cover the time constants that are of interest which occur in refiners; namely, from about 0.3 to 0.9 seconds. With earlier techniques it has not been possible to carry out such rapid measurements and, accordingly, it has not been possible to adequately control the refiners. By measuring along the radius of the beating disks, it is now possible to obtain a time-and space-separated information which can be used for controlling the quality of the fibrous mass.

The specific concept of the present invention is to keep the temperature and/or pressure curves constant over time and to therefore minimize the variations. This can be accomplished by coupling the information for these measures to one or more of the control variables mentioned above; namely, the speed of the feeding screw for the flow of chips, the flow of dosing water to the refiner, and the hydraulic pressure which regulates the distance of the beating disks from each other.

If so-called "twin refiners" are used, the distribution between the feeding screws can come into question, but the principle of the present invention and use of the above-mentioned parameters remains fully valid. The present invention is also useful for socalled double disk refiners, and in cone refiners in which the beating disks are in the shape of cones.

By measuring the pressure and temperature along the radius, the time that the fiber remains in the refiner can also be calculated. Moreover, the speed curve for the vapor can be divided, and the time that the mass is present up to the so-called pressure peak, as well as the time that the mass is present from the pressure peak to the periphery, can also be calculated. This means that a relative measure can be created which, together with the total integral for the flow of fibrous mass through the refiner, can provide information about how the refining of the chips (mass) occurs. By means of the present invention it has accordingly been determined precisely how the temperature and pressure curves can be used directly in order in order to relate them to the quality of the mass.

By measuring according to the present invention, information on possible vibrations and pulsations in the refiner may also be obtained. Vibrations may arise in different ways, for example by damaging a bearing. Also, pulsations may arise due to the fact that the disks of the refiner are not completely parallel on the inner side, so that a pumping effect is created. With measuring according to the present invention, these phenomena can thus be dealt with.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A method for controlling the beating of fibrous material to be treated in a refiner including a pair of juxtaposed radially extending refiner disks defining a beating zone therebetween said method comprising measuring at least one predetermined property of said fibrous material treated in said refiner, measuring at least one of the temperature and pressure in said beating zone along the radius of at least one of said pair of refiner disks, and altering said temperature in said beating zone based upon said measured at least one predetermined property of said fibrous material treated in said refiner.

2. The method of claim 1 wherein said altering of said temperature in said beating zone is effected by controlling a predetermined parameter within said beating zone.

3. The method of claim 2 wherein said predetermined parameter in said beating zone is selected from the group consisting of the applied pressure on one of said pair of said refiner disks, the rate of flow of said fibrous material into said beating zone, the rate of flow of nozzle water into said beating zone, and the steam pressure in said beating zone.

4. The method of claim 1 wherein said at least one predetermined property comprises a property selected from the group consisting of dewatering ability, fiber length, fiber width, proportion of shives, and tear resistance.

5. The method of claim 1 wherein said at least one predetermined property comprises a property selected from the group consisting of light dissipation and tensile strength.

6. The method of claim 1 including comparing said measured at least one value of said temperature and pressure to desired values for said temperature and pressure, and wherein variations in said temperature and pressure based on said comparison are utilized for said altering of said temperature in said beating zone.

7. The method of claim 6 wherein said comparing of said measured at least one value of said temperature and pressure with said desired values for said temperature and pressure are carried out in a computer.

8. Apparatus for controlling the beating of fibrous material to be treated in a refiner including a pair of juxtaposed refiner disks defining a beating zone therebetween, said apparatus comprising pressure and temperature gauges for measuring the pressure and temperature in said beating zone, measuring means for measuring at least one predetermined property of said fibrous material treated in said refiner, a computer for comparing said measured value of said at least one of said temperature and pressure with a desired value for said pressure and temperature, and control means for altering said temperature in said beating zone based upon said measured value of said at least one predetermined property of said fibrous material treated in said refiner.

9. The apparatus of claim 8 wherein said control means controls a predetermined parameter within said beating zone.

10. The apparatus of claim 9 wherein said predetermined parameter is selected from the group consisting of the applied pressure one of said pair of on said refiner disks, the rate of flow of said fibrous material into said beating zone, the rate of flow of nozzle water into said beating zone, and the steam pressure in said beating zone.

11. The apparatus of claim 8 wherein said measuring means comprises means for measuring at least one predetermined property comprising a property selected from the group consisting of dewatering ability, fiber length, fiber width, proportion of shives and tear resistance.

12. The apparatus of claim 8 wherein said measuring means comprises means for measuring at least one predetermined property comprising a property selected from the group consisting of light dissipation and tensile strength.

* * * * *

UNITED STATES PATENT AND TRADEMARK OFFICE

CERTIFICATE OF CORRECTION

PATENT NO. : 6,024,309

DATED : February 15, 2000

INVENTOR(S) : Karlström

It is certified that error appears in the above-identified patent and that said Letters Patent is hereby corrected as shown below:

Column 3, line 36, "us" should read -- of --.
Column 4, line 46, before "controlling", insert -- the -- and cancel the word "the" (second occurrence).
Column 4, line 52, "VALUEs" (second occurrence) should read -- VALUES --.
Column 5, line 6, cancel the word "a".
Column 5, line 21, "socalled" should read -- so-called --.
Column 6, line 49, after "pressure", insert -- on -- and after the word "of" (second occurrence), cancel the word "on".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*